US006152966A

United States Patent [19]

Conrad et al.

[11] Patent Number: 6,152,966

[45] Date of Patent: Nov. 28, 2000

[54] TREATMENT OF CORK WITH A PHENOL OXIDIZING ENZYME

[75] Inventors: Lars Sparre Conrad, Bronshoj, Denmark; Wolf Rüdiger Sponholz, Eltville/Rhein, Germany; Otto Berker, Bjerringbro, Denmark

[73] Assignee: Novo Nordisk A/S, Bagsvaerd, Germany

[21] Appl. No.: 09/296,439

[22] Filed: Apr. 21, 1999

Related U.S. Application Data

[60] Provisional application No. 60/086,007, May 19, 1998, and provisional application No. 60/119,785, Feb. 11, 1999.

[30] Foreign Application Priority Data

May 13, 1998 [DK] Denmark ..... 1998 00656
Feb. 5, 1999 [DK] Denmark ..... 1999 00153

[51] Int. Cl.[7] ..... B22K 7/00; B08B 3/04; D06L 3/04

[52] U.S. Cl. ..... 8/111; 8/103; 8/401; 510/392; 510/393; 510/530; 215/355

[58] Field of Search ..... 510/392, 393, 510/530; 8/103, 111, 401; 215/355

[56] References Cited

U.S. PATENT DOCUMENTS 4,693,757 9/1987 Sabate et al. ..... 134/27
5,098,447 3/1992 Zucchini et al. ..... 8/203

FOREIGN PATENT DOCUMENTS 0 413 343 A2 2/1991 European Pat. Off. .
0 760 362 A1 3/1997 European Pat. Off. .
WO 95/33836 12/1995 WIPO .
97/13628 4/1997 WIPO .
WO 97/11894 4/1997 WIPO .
WO 9713628 4/1997 WIPO .
WO 98/50344 11/1998 WIPO .

OTHER PUBLICATIONS

Folin et al., (1927) The J. of Biological Chem. 73(2) :627–650.

Singleton et al., "Colorimetry of total phenolics with phosphomolybdic–phosphotungstic acid reagents", pp. 144–158.

van Oss et al., (1987) Elsevier Science Publishers, pp. 35–64.

Official Methods of Analysis of the Assoc. of Official Agricultural Chemists (1965) pp. 231–232.

Grant et al., "Chemical Dictionary" p. 574.

W. –D. Rudorf, Tetrahedron, vol. 36, pp. 1791–1799 (1980).

Abstract of article by Augustin et al., Synthesis and reactivity of phenylsulfonylcyanoketene–s, S–acetals (1977).

*Primary Examiner*—Kery Fries
*Attorney, Agent, or Firm*—Steve T. Zelson, Esq.; Elias J. Lambiris, Esq.

[57] ABSTRACT

Disclosed is a process for preparing cork articles, in particular cork stoppers for wine bottles, which involves treating cork with a phenol oxidizing enzyme. Preferred phenol oxidizing enzymes are laccase, peroxidase, catechol oxidase, and o-aminophenol oxidase. The treatment with a phenol oxidizing enzyme reduces the characteristic cork taint/astringency which is frequently imparted to the bottled wine.

12 Claims, No Drawings

TREATMENT OF CORK WITH A PHENOL OXIDIZING ENZYME

CROSS-REFERENCE TO RELATED APPLICATIONS

This application claims priority under 35 U.S.C. 119 of U.S. provisional application Nos. 60/086,007 and 60/119,785 filed May 19, 1998 and Feb. 11, 1999, respectively, and of Danish application nos. PA 1998 00656 and PA 1999 00153 filed May 13, 1998 and Feb. 5, 1999, respectively, the contents of which are fully incorporated herein by reference.

TECHNICAL FIELD

This invention relates to a process for preparing or treating cork or cork articles such as cork stoppers. Cork stoppers are used in various closures for perfumed compositions and alcoholic beverages such as wine, champagne and beer.

BACKGROUND ART

Cork is bark from the cork oak, e.g. *Quercus suber L*, which grows predominately in countries near the Mediterranean Sea. Wine corks are produced from reproduction cork, which is bark that has re-grown after the original bark has been stripped off the tree.

The production of cork stoppers commences with the stripping of the reproduction bark from the tree to provide cork slabs. These slabs are stored for up to two years. Usually, the slabs are then graded and often bundled, boiled in water and stacked once more. Abundant mould growth may occur during storage.

The further production steps vary according to the actual cork stopper type, the intended use thereof, and any special demands the end-user might have.

Several types of cork stoppers are known.

Natural cork stoppers are inter alia used as closures for wine bottles. Such stoppers are cut or punched generally in the cork slab longitudinal plane.

Natural cork slices or disks are used inter alia in the production of laminate cork stoppers typically used as closures for champagne bottles. Still further, cork slices are used for sealing purposes at the inner bottom of various screw caps. Slices are usually cut perpendicular to the longitudinal direction of the cork slab.

Around 50% of the slab material can be used for natural cork stoppers or slices. The remaining material, viz. cork pieces or crumbs of varying size, is generally used for preparing granulate cork. Very small cork particles can be used directly in the heating system of the factory as an energy source.

Granulate cork can be used for various purposes, among other things in the production of agglomerated stoppers. To this end the crumbs are ground, cleaned and classified into various particle ranges. Binders, and if desired other additives such as plasticizers and cutting aids, are mixed with the granulated cork of the desired particle size, and the composition is moulded or extruded into shape. Optionally, the thus formed product is then polished.

Laminate cork stoppers are usually used for large stoppers such as champagne bottles. Such stoppers comprise a stopper body and one or more slices or disks of natural cork at the lowermost body part. The body part is typically made of agglomerated cork. The different portions are typically glued together.

Liqueur or liquor stoppers usually comprise a cork body part, be it natural or agglomerated, and a top part. The top part is typically made from plastic, wood or cork. The two portions are glued together.

The manufacturing process of cork slices or cork stoppers, whether natural, agglomerated or laminated, usually includes a step of bleaching the cork. The traditional bleaching process uses hypochlorite, usually calcium hypochlorite. Oxalate is then used as a reductant. The precipitation of calcium oxalate endows the stoppers with an appealing white appearance. Alternatively, hydrogen peroxide is used, with citric acid or the enzyme catalase for the subsequent degradation of residual hydrogen peroxide.

This bleaching is for the purpose of cosmetic appearance and disinfection.

Finally, the water content of the cork articles is adjusted to the desired level, usually 5–8%. This is for the purpose of ensuring the microbial stability of the stoppers. Usually, the stoppers are dried in a stream of warm air, and then packaged.

Cork is a highly desirable stopper material, inter alia due to its excellent gasketing characteristics and its high resistance to water, most organic liquids and all but strong acid and alkali solutions. However, frequently a characteristic cork taint is imparted to packaged goods in contact with cork, be it beverages, foods or various perfumed compounds. Cork taint is an off-flavor (taste or odour foreign to the product), frequently described as musty, mouldy or earthy. Astringency, bitterness and tannic flavor are specific variants of cork off-flavor.

DISCLOSURE OF THE INVENTION

It is the object of the invention to reduce the cork taint, in particular the astringency and/or bitterness and/or tannic flavor, imparted to food or perfumed products in contact with cork. According to the invention, this object is achieved by treating or impregnating cork or cork articles with a phenol oxidizing enzyme.

Thus, in a first aspect the invention relates to a process for preparing cork articles which comprises the step of treating cork with a phenol oxidizing enzyme.

The invention also relates to a process for the treatment of cork, which comprises the step mentioned above.

In a second aspect, the invention relates to the use of a phenol oxidizing enzyme in the preparation or treatment of cork or cork articles.

And in a third aspect, the invention relates to a cork article (or cork) obtainable, in particular obtained, by any of the processes described herein.

Quite interestingly, the treatment of cork stoppers with a phenol oxidizing enzyme has been found to increase their water repellency.

Accordingly, the invention, in a fourth aspect, relates to a cork article (or cork) which is characterized by an increased water repellency, as compared to a relevant control article which has been treated or prepared exactly as the article in question, except for the treatment with a phenol oxidizing enzyme. The test below is a preferred test for water repellency. A preferred relevant control article is of the same batch and the same quality as the article in question.

Finally, the invention also relates to objects, preferably packaging objects, such as containers, boxes, cases, casks, glasses, bottles and the like, which objects are closed, sealed or stopped using a cork or a cork article of the invention. Preferred objects are bottles. Preferred bottles contain red or white wine, champagne, liquor, beer, lemonade, juice and the like; or perfumes; or other liquid compositions.

Water repellency can be detected or traced by a wetting analysis using the Lif-shitz-van der Waal/Lewis acid-base approach (van Oss C. J., M. K. Chaudhury and R. J. Good, 1987; Monopolar Surfaces; Advances in Colloid and Interface Science, 28, 35–64; hereby incorporated by reference) The Lewis base component and thereby the ability of the surface layer to donate electrons is drastically reduced by an oxidative treatment of the invention. Contrary, the Lewis acid component is not or only very little affected by such treatment. An oxidation using other oxidizing agents, e.g. hydrogen peroxide, will show a different Lewis acid/base pattern.

It is conceivable that treatment of cork or cork articles such as stoppers with a phenol oxidizing enzyme will also have a sterilizing effect (the combination of certain phenols with a phenol oxidizing system is known to have an antimicrobial effect).

It is also conceivable that by treating cork slabs with a phenol oxidizing enzyme the storage time can be reduced.

Furthermore, it appears that the treatment of the invention improves the uniformity of a batch of wine, probably by eliminating or reducing the impact from cork stoppers of varying quality on the flavor or taste of such batch (see Example 3). Thus, in a way, the invention sets a new and improved standard for uniformity of flavor or taste, in particular for wine and the like alcoholic beverages.

An oxidation is an electron transfer reaction between two reactants: A donor looses an electron, an acceptor gains the electron; one of the reactants is oxidized (the electron donor), the other reactant is reduced (the acceptor). Enzymes catalyzing such reactions are called oxidoreductases.

Phenol oxidizing enzyme

In the present context the concept of a "phenol oxidizing enzyme" includes any oxidoreductase acting on phenols and related substances as donors with oxygen or hydrogen peroxide as acceptor, as well as enzymes which are positive in the test of Example 1 herein. This definition includes enzymes derived from animals, plants and microorganisms, as well as mutants and variants thereof which retain their phenol oxidizing enzymatic activity.

Generally, this concept of a "phenol oxidizing enzyme" includes whatever compounds necessary for the actual enzyme to work, i.e. for instance an appropriate acceptor. Such acceptor may or may not be naturally present in the reaction system.

However, whenever it is desirable to underline the presence of the acceptor, the concept of a "phenol oxidizing enzyme system" can be used, viz. to mean a phenol oxidizing enzyme plus its acceptor.

Other components such as activators etc. are included in the concept of a "phenol oxidizing enzyme system" to the extent such components are desirable for the enzyme to work optimally under the actual conditions. This optimization of the enzyme catalyzed reaction is a matter of routine for the skilled man, once a specific enzyme has been selected.

In the present context, the concept of "phenols" means any compound which comprises at least one phenolic ring structure, i.e. an aromatic ring structure, in particular a benzene ring structure, with at least one OH-substituent at a ring C-atom, whatever other substituents, and whatever the number of condensed benzene rings. This definition, in particular comprises (mono)phenols, as well as polyphenols, such as di-, tri-, tetra-, penta- and hexaphenols. Also comprised in this definition are tannins (see e.g. Grant & Hackh's Chemical Dictionary, $5^{th}$ edition, McGraw-Hill Book Company, 1987, p. 574 in particular, hereby incorporated by reference).

Guaiacol (2-methoxyphenol) is one example of a phenol detected in tainted wine and its associated cork. The guaiacol taint is described as smokey, phenolic or medicinal. Several other phenols are contemplated to contribute to the overall off-flavor.

Some phenols of cork are probably formed as a result of the microbial degradation of the cork material, however these reactions are still poorly understood. And phenols are also produced by the tree itself. But, still, other explanations regarding the origin of phenols in cork are also plausible.

The composition of a cork material depends on its growth conditions, however a typical natural cork contains around 16 weight % lignin and 4 weight % tannins and miscellaneous organics, such as resorcinol, hydroquinone, salicylic acid, phloroglucinol and sterols.

Further examples of phenols of potential relevance to cork taint are pentachlorophenol, 2,3,4,6-tetrachlorophenol, 3,4,5-trichlorophenol, 2,4,6-trichlorophenol; dichlorocresols, such as derivatives of o-cresol, m-cresol and p-cresol.

Another phenolic compound believed to be a major contributor to cork off-flavor is TCA (2,4,6-trichloro anisole) (Wine—microbiology and biotechnology, Graham H. Fleet (Ed.), Harwood Academic Publishers, 1993, pp.359–360). Anisoles are probably formed in the cork by microbial transformation of phenols.

Cork and cork articles

The concept of "cork" as used herein includes bark from trees, in particular from cork oaks, whatever the physical form thereof, be it slabs, larger or minor parts thereof, such as cut-out stoppers and slices, as well as crumbs or compositions comprising crumbs, e.g. granulate cork. Also any more or less worked up cork intermediate products (on the way to cork articles) are included in the definition of cork. Finally, the expression "cork" is also intended to cover the expression "cork articles."

In the present context, a "cork article" is an article which contains cork. In other words: A cork article is the result of performing one or more process steps for which cork is used as a raw material. A typical cork article is an article of commerce. Preferred cork articles or products are cork closures or cork closure components, e.g. cork stoppers, cork slices or cork disks. Other preferred cork articles are granulate or agglomerated cork articles. Preferred cork stoppers are natural cork stoppers, laminate cork stoppers and agglomerated cork stoppers.

Treatment with phenol oxidizing enzyme

The treatment or impregnation of cork with a phenol oxidizing enzyme can be performed in various ways. Basically, a composition comprising such enzyme (the enzyme preparation, be it liquid or dry) is applied to or brought into contact with cork. The enzyme preparation is preferably liquid. Preferred methods of treating or impregnating cork with liquid enzyme preparations are by dipping, spraying, immersing, injecting.

The interaction between the enzyme and the cork material may be enhanced, and the enzymatic effect on the cork material thus improved, by any means which improve the contact between enzyme and cork and/or the access of the enzyme to cork surface areas. In particular, enzyme access to the so-called lenticels of the cork (the brown "eyes") is believed to be advantageous.

The following is a non-exclusive list of means improving such contact and/or access ("contact-improving means"): Means which minimize the water repelling effect of the cork surface, e.g. surface tension lowering compounds and compositions; solvents; mechanical means such as ultrasonic treatment, aeration, stirring, vacuum, overpressure.

Other means will be readily apparent to the skilled person.

Any combination of these means can also be used.

In a preferred embodiment, suitable solvents, preferably an alcohol such as ethanol, is added to the enzyme containing treatment liquid.

Thus, preferably, the enzyme treatment takes place in a liquid comprising water and ethanol. A preferred amount of ethanol is in the range of 1–30%, preferably 2–25%, more preferably 3–20%, even more preferably 5–15% (all percentages in vol/vol).

In another preferred embodiment the treatment takes place in an ultrasonic bath.

Preferably, the ultrasonic treatment is combined with using a liquid which comprises alcohol.

The step of treating cork with a phenol oxidizing enzyme can be performed at any step in the preparation of cork articles. Preferably, the impregnation should take place following the cutting of the cork slabs. However, impregnation of already finalized cork articles is a preferred option. If desired, repeated steps of impregnating with a phenol oxidizing enzyme can be performed over the whole life time of the cork article.

A typical process for preparing cork stoppers ends up with a bleaching step and a final drying step. Optionally, a further disinfection step is included.

Preferably, the treatment of the invention is performed following the bleaching step, in particular following the drying step or the disinfection step, whatever the later. There might very well be a lap in time before the treatment of the invention is performed, for instance it can also be performed by the end user, i.e. immediately before bottling a wine. It is preferably followed by a drying step (see above).

In another preferred embodiment the treatment of the invention is performed before the bleaching step.

Preferred phenol oxidizing enzymes

Preferably, the phenol oxidizing enzyme is a phenolic oxidase or a peroxidase.

Preferred phenolic oxidases are enzymes of classes EC 1.13.-.-; EC 1.14.-.- and EC 1.10.3.-, in particular any of the classes EC 1.10.3.1-1.10.3.8, and preferred peroxidases are enzymes of class EC 1.11.1.7 (Enzyme Nomenclature, 1992, Published for the International Union of Biochemistry and Molecular Biology (IUBMB) by Academic Press, Inc.; 1992).

The group EC 1.11.1.7 comprises peroxidases, catalyzing oxidation reactions in which a donor is oxidized, hydrogen-peroxide acting as the acceptor.

The grouping EC 1.10.3.- comprises enzymes acting on diphenols and related substances as donors with oxygen as acceptor. Preferred enzymes of these classes are: Catechol oxidases (EC 1.10.3.1); laccases (alternative name urishiol oxidases, EC 1.10.3.2); and o-aminophenol oxidases (EC 1.10.3.4). Monophenols, however, are also very good substrates.

The grouping EC 1.14.18.1 comprises monophenol monooxygenase (alternative name tyrosinase, phenolase, monophenol oxidase, cresolase).

The phenol oxidizing enzymes are preferably purified, viz. only minor amounts of other proteins being present. The expression "other proteins" relate in particular to other enzymes. Preferably, the enzymes are at least 75% (w/w) pure, more preferably at least 80, 85, 90 or even at least 95% pure. In a still more preferred embodiment the phenol oxidizing enzyme is at least 98% pure enzyme protein.

Preferred phenol oxidizing enzymes are listed below. Any enzymatically active variants or mutants thereof are also preferred phenol oxidizing enzymes. The activities thereof can be measured by any method known in the art.

Suitable peroxidases may be any peroxidase enzyme comprised by the enzyme classification (EC 1.11.1.7), or any fragment derived therefrom, exhibiting peroxidase activity. Preferably, the peroxidase is derived from plants (e.g. horseradish or soybean peroxidase) or microorganisms such as fungi or bacteria. Some preferred fungi include strains belonging to the subdivision Deuteromycotina, class Hyphomycetes, e.g., Fusarium, Humicola, Trichoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillium alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the sub-division Basidiomycotina, class Basidiomycetes, e.g. Coprinus, Phanerochaete, Coriolus or Trametes, in particular *Coprinus cinereus f. microsporus* (IFO 8371), *Coprinus macrorhizus, Phanerochaete chrysosporium* (e.g. NA-12) or Trametes (previously called Polyporus), e.g. *T. versicolor* (e.g. PR4 28-A).

Further preferred fungi include strains belonging to the sub-division Zygomycotina, class Mycoraceae, e.g. Rhizopus or Mucor, in particular *Mucor hiemalis.*

Some preferred bacteria include strains of the order *Actino-mycetales,* e.g., *Streptomyces spheroides* (ATTC 23965), *Streptomyces thermoviolaceus* (IFO 12382) or *Streptoverticillum verticillium* ssp. *verticillium.*

Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g., *M. virescens.*

Particularly, a recombinantly produced peroxidase is preferred, e.g., a peroxidase derived from a Coprinus sp., in particular *C. macrorhizus* or *C. cinereus* according to WO 92/16634, or a variant thereof, e.g., a variant as described in WO 94/12621.

Laccase enzymes of microbial and plant origin are well known. A suitable microbial laccase enzyme may be derived from bacteria or fungi (including filamentous fungi and yeasts) and suitable examples include a laccase derivable from a strain of Aspergillus, Neurospora, e.g., *N. crassa*, Podospora, Botrytis, Collybia, Fomes, Lentinus, Pleurotus, Trametes, e.g., *T. villosa* and *T. versicolor*, Rhizoctonia, e.g., *R. solani*, Coprinus, e.g. *C. plicatilis* and *C. cinereus*, Psatyrella, Myceliophthora, e.g. *M. thermophila*, Scytalidium, Polyporus, e.g., *P. pinsitus*, Phlebia, e.g., *P.*

*radita* (WO 92/01046), or Coriolus, e.g., *C. hirsutus* (JP 2-238885), in particular laccases obtainable from Trametes, Myceliophthora, Scytalidium or Polyporus.

A suitable catechol oxidase may be derived from *Solanum melongena* (Phytochemistry, 1980, 19(8), 1597–1600) or from tea (Phytochemistry, 1973, 12(8), 1947–1955). Polyphenol oxidase may be derived from molds (Hakko Kogaku Zasshi, 1970, 48(3), 154–160). A mammalian monophenol monooxygenase (tyrosinase) has been described (Methods Enzymol., 1987, 142, 154–165). Other suitable monophenol monooxygenases can be derived from tea leaves (Prikl. Biokhim. Mikrobiol., 1997, 33(1), 53–56), from Chlorella (Ukr. Bot. Zh., 1986, 43(5), 56–59) or from *Neurospora crassa* (Methods Enzymol., 1987, 142, 165–169).

Appropriate conditions under which the treatment of the invention with a phenol oxidizing enzyme should occur, are selected paying regard to the characteristics of the enzyme of choice, some typical conditions being listed below. Generally, of course any of these conditions can be optimized using simple trial-and-error experiments as is usual in the art.

A generally preferred pH of the treatment liquid is pH 3–10, preferably 3.5–9, more preferably 4–8, still more preferably 4–7.

A generally preferred temperature in the treatment step of the invention is 10–80° C., preferably 10–70° C., more preferably 15–60° C., still more preferably 20–50° C., most preferably 20–40° C.

A generally preferred treatment time is 5 minutes to 5 hours, preferably 5 minutes to 4 hours, more preferably 15 minutes to 3 hours, still more preferably ½ to 2 hours.

The concentration of oxygen as acceptor (relevant to the use of phenolic oxidases only, viz. e.g. laccase) is not critical. At 25° C. and in normal atmosphere, water has an equilibrium concentration of oxygen of around 200 $\mu$M which is usually fully sufficient for the enzyme reactions to occur in a satisfactory way. If desired, however, of course the oxygen concentration of the impregnation liquid could be increased, e.g. to saturation.

The concentration of hydrogen peroxide as acceptor (relevant to the use of peroxidase only) is generally not critical. However, the selected peroxidase enzyme could be sensible to hydrogen peroxide (loose activity) . Preferably the concentration range of hydrogen peroxide is 0.010–10 mM, more preferably 0.020–8 mM, still more preferably 0.05–5 mM, even more preferably 0.100–2.5 mM.

Generally, a preferred dosage of the phenol oxidizing enzyme is 0.001–1000 mg enzyme protein per liter treatment liquid, preferably 0.01–100 mg, more preferably 0.1–20 mg/liter. The amount of enzyme protein can be measured using any method known in the art. These dosage values are preferably based on purified enzyme protein, purified being defined as indicated above.

EXAMPLES

Example 1

Treatment of cork slices with a phenol oxidizing enzyme

Cork slices for champagne cork stoppers are treated with a phenol oxidizing enzyme as described below. The amount of phenols extracted from the cork slices after the treatment is measured and compared to a control. The cork slices treated with a phenol oxidizing enzyme show a reduced level of extracted phenols.

Five different cork slice qualities are used, viz. Extra Riserva, (1–2), (3), (4) and Tipo 5, here listed in the order of decreasing cork quality.

Phenol oxidizing enzyme: A laccase enzyme derived from *Myceliophthora thermophila* (prepared as described in WO 95/33836, Examples I–III; hereby incorporated by reference) The enzyme is added to water to obtain a concentration of 6.7 mg enzyme protein/l in the final treatment liquid.

Treatment liquid pH 7, room temperature. Ten slices are transferred to 200 ml impregnation liquid and kept in contact with the liquid for 30 minutes under stirring.

Control experiments are conducted with each of the above mentioned qualities as described above, except for no enzyme being included.

Following this treatment, all experimental and control slices are washed thoroughly in copious amounts of water, e.g. three times, and boiled in fresh water for 5 minutes (10 slices/200 ml) to extract phenols from the cork slices.

Test for water-extractability of phenols: The content of phenols in the thus boiled, fresh water is assayed using a Folins reagent which imparts a blue color proportional to the amount of phenolic compounds extracted. Folins reagent is i.a. described in J. Biol. Chem. 73, 1927, p. 627–650, authors: Folin, O. and Ciocalteau, V. C. (hereby incorporated by reference). Another reference is ABC Chemie, Verlag Harni Deutsch, Frankfurt/Main & Zuirich, 1965: Folins Reagent, Folin and Ciocalteau, sodium wolframate, sodium molybdate, phosphoric acid and lithium sulphate, reacts with phenols to give a blue color). A third reference, also hereby incorporated by reference, is: Official Methods of Analysis of The Association of Official Agricultural Chemists, $10^{th}$ edition, 1965, p. 231–232. A further, preferred, method is described in Am. J. Enol. Vitic. 1965, 16, 144–158; Singleton et al: "Colorimetry of total phenolics with phosphomolybdic-phosphotungstic acid reagents" (hereby incorporated by reference), see in particular the preparation of the Folin-Ciocalteu reagent at p. 145, columns 1–2, as well as the paragraph headed "The improved method-precision and accuracy" at p. 156, $1^{st}$ column. If required, gallic acid is preferably used as a reference standard. It should be noted, however, that only informative relative values are required for the present purpose.

The results (absorbency at 600 nm) are shown in table 1 below.

TABLE 1

| Cork slice quality | Control | Enzyme |
|---|---|---|
| Extra riserva | 0.525 | 0.280 |
| 1–2 | 0.125 | 0.100 |
| 3 | 0.210 | 0.190 |
| 4 | 0.250 | 0.200 |
| Tipo 5 | 0.080 | 0.080 |

This assay can be used to test whether a given enzyme can be expected to reduce the cork off-flavor, viz. whether it falls under the definition herein of a phenol oxidizing enzyme. This can be expected if a reduced absorbency results, as compared to the control, for at least one of the cork qualities. Such enzymes are called "positive" in this assay. Of course, the assay conditions should reflect the characteristics of the selected enzyme to test (in particular its pH and temperature characteristics). It lies within the routine capability of the skilled person to elect such conditions or to set up suitable simple experiments to establish such optimum conditions. For instance the above assay can be tried at three to four different pH values, preferably in the interval of pH 4–10, and at three to four different temperatures, e.g. ranging from 10 to 80° C.

Example 2

Sensory evaluation of champagne, the stoppers of which have been treated with a phenol oxidizing enzyme Three cork slice qualities are used in this experiment, viz. quality grades called 1, 3 and Tipo 5. Quality grade 1 is the higher quality, 3 a medium quality and Tipo 5 the lower quality grade.

In total 300 slices are treated in an ultrasonic bath in 2 liters of an aqueous solution containing 15 (vol/vol)% ethanol with 1.3 mg laccase added (the laccase as desribed in Example 1). pH is adjusted to 4.5. The enzyme solution is discharged after 30 minutes, and the slices are washed in 2×2 liters of water, and dried at 50° C.

A reference experiment is performed without addition of laccase.

The slices are then glued to the corpus, and the stoppers brought into the right size and shape by cutting and sanding (to produce champagne stoppers).

Six times 100 bottles of sparkling wine are bottled, and the wine is tasted after 3 months.

Four tasters have evaluated the wine from bottles corked with the 6 different cork stoppers (3 cork stopper qualities, +/− laccase treatment), three bottles of each experiment, and they gave an average grade for each experiment as follows: Grade 1 for the best taste (lowest off-taste), grade 2 for a slightly worse off-taste, etc. The worst tasting wine was graded 6 (worst taste, highest level of off-taste). In the cells of rows 1, 2, 3, 4, 5 and 6 of Table 2 below, the number of tasters is indicated who gave the grades of 1, 2, 3, 4, 5 and 6, respectively, to the wine of each column.

These grades are now weighted by multiplying the number of tasters in row 1 by 1, in row 2 by 2, in row 3 by 3, and so forth. For each wine (experiment), these multipla are then added to give the overall off-taste score of each wine: The higher the score, the worse the off-taste in the wine.

In the lowermost row of Table 2 the wines are finally ranked according to their off-taste score.

In conclusion, treatment of cork stoppers with a phenol oxidizing enzyme reduces the off-taste of the wine—for all cork stopper qualities.

Furthermore, by treating the lowermost quality cork stopper, Tipo 5, with the phenol oxidizing enzyme, the wine corked with such stopper even bypasses the wine which is corked with non-laccase treated cork stoppers of the higher quality 3.

TABLE 2

| Number of samples being evaluated as | Stopper Quality +/− laccase treatment | | | | | |
|---|---|---|---|---|---|---|
| Off-taste grade no. | 1/+ | 1/− | 3/+ | 3/− | Tipo 5/+ | Tipo 5/− |
| 1 (low off-taste) | 3 | 1 | | | | |
| 2 | 1 | 2 | 1 | | | |
| 3 | | 1 | 2 | | 1 | |
| 4 | | | 1 | 1 | 2 | |
| 5 | | | | 3 | 1 | |
| 6 (high off-taste) | | | | | | 4 |
| Off-taste Score | 5 | 8 | 12 | 19 | 16 | 24 |
| Ranking | 1 | 2 | 3 | 5 | 4 | 6 |

Example 3

Sensory evaluation of white wine, the stoppers of which have been treated with a phenol oxidizing enzyme; uniformity testing 20000 stoppers of quality designation "2" are treated in a rotating drum with 100 l of water, 15 l of ethanol, and with 125 mg laccase (as described in Example 1). pH is adjusted to 4.5. The enzyme solution is discarded after 30 minutes, and the stoppers are rinsed in water and dried.

The thus treated stoppers are used to seal bottles of two different kinds of German white wine. These bottles are then subjected to an accelerated ageing for 4 weeks: The bottles are kept in the refrigerator (5° C.) during night, and at room temperature (20–25° C.) during the day.

After the ageing process, the (content of the) bottles are evaluated by a taste panel consisting of 3 skilled tasters. The tasting protocol is as follows: The bottles are divided, each type of wine separately, into groups of six bottles. The panel tastes the six bottles from group No. 1, and decides whether the bottles have a uniform taste. If so, one bottle from group No.2 is tasted, and it is decided whether the taste of that bottle is identical to that of the six bottles from group No. 1. If so, the remaining five bottles in group No. 2 are tasted, and it is decided whether the taste of the five bottles is identical to the taste of the first bottle from group No. 2. If so, the panel continues, tasting one bottle from group No. 3, and so on.

Forty-eight bottles of each type of white wine were evaluated, with the result that all forty-eight bottles of each type of wine were identical in taste, and with no phenolic off-taste. Usually, trained tasting experts would find some degree of variation in taste within one particular batch of wine. But this result surprisingly shows that laccase treated stoppers are organoleptically neutral, in the sense that they do not contribute to the taste of the wine, and thus contribute to a greater uniformity of wine flavor or taste within a particular batch of wine. It is an obvious advantage that bottled wines develop and age uniformly, and independently of the stopper.

What is claimed is:

1. A process for preparing cork articles which comprises the step of treating cork with a phenol oxidizing enzyme.

2. A process for the treatment of cork which comprises the step of treating cork with a phenol oxidizing enzyme.

3. The process of claim 1, wherein the phenol oxidizing enzyme is an enzyme which is positive in the assay of Example 1 herein.

4. The process of claim 1, wherein the phenol oxidizing enzyme is a phenolic oxidase or a peroxidase.

5. The process of claim 4, wherein the phenolic oxidase is selected from the group consisting of catechol oxidase, laccase and o-aminophenol oxidase.

6. The process of claim 1, wherein the cork articles are cork stoppers or cork slices.

7. The process of claim 1, which further comprises one or more of the following steps:

(i) a bleaching; and/or (ii) a drying; and/or (iii) a disinfection.

8. A cork or cork article obtained by the process of claim 1.

9. A cork or cork article characterized by an increased water repellency.

10. An object carrying a cork or a cork article according to claim 8.

11. The object of claim 10 which is a bottle.

12. The object of claim 11 which is a bottle of wine or champagne.

* * * * *